United States Patent [19]

Andersson

[11] 4,369,898

[45] Jan. 25, 1983

[54] FILLING MACHINE

[76] Inventor: Ake Andersson, Slätvarsgatan 23, Västra Frölunda, Sweden, 42179

[21] Appl. No.: 884,566

[22] Filed: Mar. 8, 1978

[30] Foreign Application Priority Data

Mar. 9, 1977 [SE] Sweden ..... 77026318

[51] Int. Cl.[3] ..... G01N 15/08; B01D 35/00

[52] U.S. Cl. ..... 222/4; 222/144.5; 222/189; 222/309; 222/334; 73/38

[58] Field of Search ..... 222/148, 189, 4, 144.5; 73/38; 210/409, 90, 92; 141/286

[56] References Cited

U.S. PATENT DOCUMENTS

| | | | |
|---|---|---|---|
| 609,183 | 8/1898 | Dunn | 222/148 |
| 2,210,934 | 8/1940 | Gleason | 239/113 |
| 3,007,334 | 11/1961 | Pall | 73/38 |
| 3,394,067 | 7/1968 | Shirley | 210/409 X |
| 3,499,387 | 3/1970 | Zippel | 222/137 X |
| 3,807,464 | 4/1974 | Pitesky | 141/286 X |

FOREIGN PATENT DOCUMENTS 1461965 1/1969 Fed. Rep. of Germany .

*Primary Examiner*—Stanley H. Tollberg
*Assistant Examiner*—Frederick R. Handren
*Attorney, Agent, or Firm*—Cantor and Singer

[57] ABSTRACT

A machine adapted to fill liquid products, under sterile conditions, into bottles has at least one quantitation pump and a piston servo motor for driving the same. The stroke of the servo motor can be adjusted to suit the quantity to be supplied to each bottle, and a sterile filter is fitted downstream of the pump. A valve is provided to disconnect the pump from the source supplying the liquid, and permit testing of the filter by means of pressurized air or gas. This may be supplied by the pump or by an external source.

6 Claims, 3 Drawing Figures

FILLING MACHINE

BACKGROUND OF THE INVENTION

Filtering and filling of solutions for medical use necessitates today two systems, one for filtering and one for filling the filtered solution. The equipment required for these operations takes up much space and is difficult to clean, as well as to connect and to disconnect. When small and medium sized batches are considered the filtering and filling steps of the production sequence take up too much time, because of the work needed for accommodating and cleaning.

The aim of the present invention is to propose a machine, where it is possible to filter a prepared solution, and to fill it in measured quantities into the desired containers in a compact, closed system, which may be easily connected, is easily cleaned and requires a small space.

A further aim is to improve the environmental conditions by supplying a machine operating at a low noise level, and where it is possible to reduce the amount of residues escaping to the ambient atmosphere.

A low noise level may be obtained by using pneumatic operation, which furthermore can easily be designed for automatic operation without the aid of any electric components. That is especially advantageous when handling products including volatile solvents.

When solutions intended for medical use are involved, there is a high demand for sterile handling, and it is essential that the filter be tested before, as well as after a filling sequence. A filter intended to be used for sterile handling of solutions for medical use has very fine cappillaries, not exceeding 0.22 $\mu$m, which are sufficient for blocking the passage of germs and spores. The test is conventionally performed by a so called bubble-point test, and a machine according to the invention is provided with means for performing such tests in a simple manner.

SUMMARY OF THE INVENTION

A filling machine according to the invention includes at least one quantitation pump, at least one piston servo motor directly connected to the pump for driving the same, means adapted to determine the stroke of the piston servo motor, and non-return valves fitted at the pump and adapted to permit the liquid product to be drawn into, and expelled from, the pump, depending upon the direction of movement of its piston.

A machine according to the invention is characterized in a filter mounted in the outlet conduit from the quantitation pump, and valve means in the supply conduit leading to the quantitation pump, and adapted, at will, to interrupt the connection between the source supplying the liquid product, and to permit the testing of the filter by subjecting it to the action of pressurized gas, or air.

The valve means is preferably arranged to permit the quantitation pump alternatively to draw in ambient air, and to force this air through the filter for testing the same. The valve means may however, alternatively be designed, for the same purpose, to connect the supply conduit which a source of pressurized gas.

A filling machine according to the invention preferably includes two parallel quantitation pumps, complete with inlet and outlet fittings, and at least one driving servo motor mounted between the pumps.

The servo motor advantageously is a piston servo motor, having throttling means for governing the amount of air passing through the motor. The means determining the stroke of the servo motor preferably comprises a toothed rack fitted in parallel to its longitudinal axis, a cross bar for cooperation with said rack and a final position adjustment screw, carried by the cross bar.

DESCRIPTION OF A PREFERRED EMBODIMENT

Figure 1:
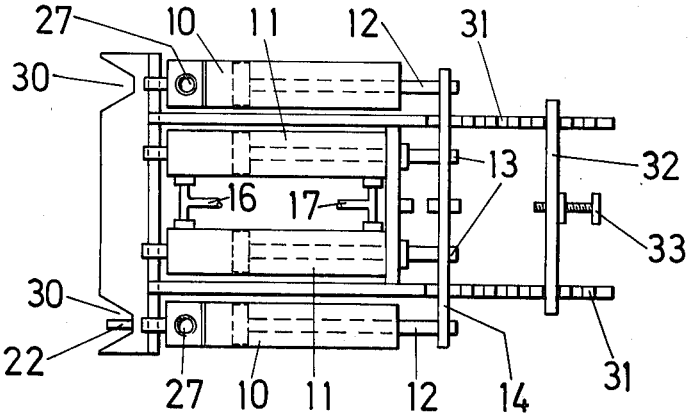
FIG. 1 shows a filling machine according to the invention, as viewed from above.
Figure 2:
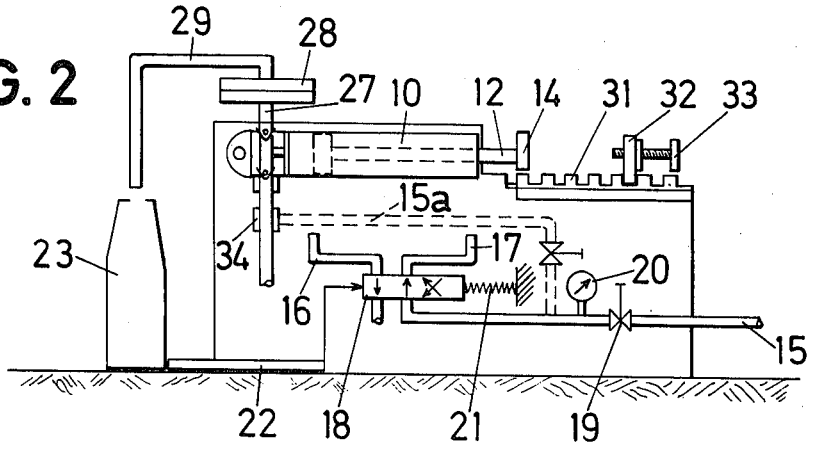
FIG. 2 shows an elevation, partly in section of the machine.

The machine shown in the drawing is adapted to handle medium sized batches of liquids intended for medical use, and to make possible a filling of two bottles simultaneously.

The machine is provided with two parallel cylinders 10 of quantitation pumps, and two cylinders 11 of a double acting piston servo motor interposed between the quantitation cylinders. All four piston rods 12 and 13, respectively, of these cylinders are interconnected by means of a yoke 14. Pumps and servo motors are designed for the same length of stroke, and the pistons of all four cylinders will thus move synchronously forwards and backwards.

Servo motors 11 are supplied with motive fluid, such as compressed air, by way of a conduit 15 connected to a suitable source (not shown). Two branch pipes 16, 17 supply motive fluid to opposite ends of each servo motor cylinder 11. An axially displaceable valve 18 is adapted, in a well known manner, to connect one of the branch pipes, 16, 17, with supply conduit 15, while simultaneously opening the other branch pipe to the atmosphere.

There is a throttle valve 19 in supply conduit 15 by the aid of which it is possible to determine the pressure of the motive fluid supplied to the servo cylinders, and thus also the speed of the filling. A pressure gauge 20 shows the pressure within the system. This further includes safety and emergency stop fittings, which are not shown in the drawing, as they form part of conventional equipment.

Displacement of valve 18 may be arranged in any suitable manner. For illustration purposes the drawing shows that the valve body is biased by a spring 21 for movement in one direction, and that it may be moved in the opposite direction by an activating member 22, which is displaced when a bottle 23 is moved into position for filling.

Figure 3:
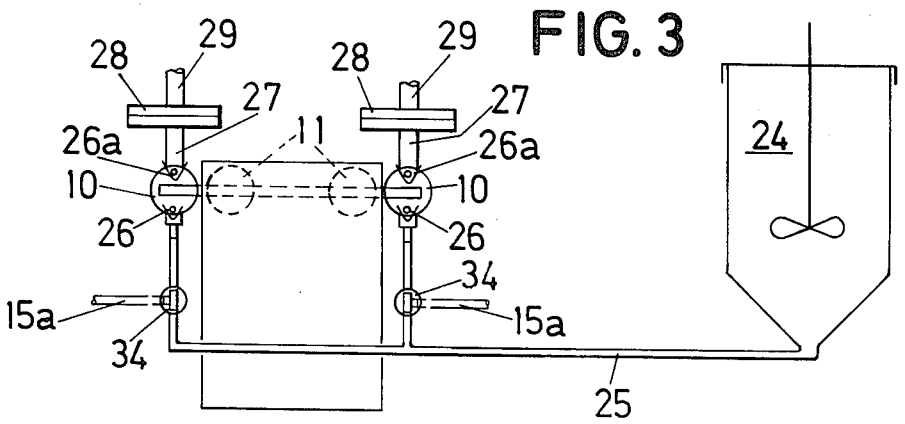
FIG. 3 shows a front view of the machine.

The solution which is to be distributed is stored in a tank 24 (FIG. 3), which by way of a conduit 25 is connected to each quantitation cylinder 10. There is a valve housing, having two non-return valves 26 and **26*a***, respectively, at each cylinder, one of said non-return valves permitting flow into the cylinder, but preventing flow in the opposite direction, while the other valve permits flow out of the cylinder, but prevents flow into the same.

The pumps, thus, can draw in fluid and then expel it at a pressure made necessary by the equipment downstream of the pumps.

In the pressure conduit 27 from each pump there is a filter 28, and from the same a conduit 29 is extended to a position suitable for the filling operation. It will thus be possible to fill two bottles simultaneously—the operator takes one bottle in each hand and presses the bottles against the machine. This is, as is evident from FIG. 1, provided with guides 30 for the bottles, directed towards the suitable filling positions. The activating member 22 for operating valve 18 is mounted in conjunction with one of those guides.

The quantity to be expelled is determined by selecting the length of the pump stroke. Two toothed racks 31 extend axially away from the cylinders, and a cross bar 32 may be fitted in any suitable position along the two racks, in oder to block the movements of piston rods 12, 13 out of the cylinders. In order to make possible a fine adjustment of the stop position cross bar 32 is provided with an adjustment screw 33, having locking means.

The filters 28 are important components with respect to the handling and it is desirable that the filters be controlled before a filling cycle is started, and also are checked when the filling is terminated, to establish that no filter has been damaged.

Such checking is normally performed by a so called bubble-point test, which, in short, means that the pressure for forcing a column of liquid through the capillaries of the filter is measured.

The filter is first saturated with the liquid to be filtered, and excess liquid is then drained off, whereupon compressed air, or pressurized gas, is supplied. The pressure is slowly increased and the pressure, at which a sudden flow of air, or gas, through the filter occurs, is noted, i.e. the pressure at which the moisture is forced out of the filter. Established values for various filters, used with given solutions and at known temperatures are tabulated, and will provide a fully satisfactory gauge for the adaptability of the filter used.

In order to make possible bubble-point tests at the machine, each inlet to a pump cylinder is provided with a three way valve 34, which can interrupt the connection with supply conduit 25 and connect the filter to a compressed air conduit 15*a*. Alternatively, conduit 15*a* may be adapted to communicate the pump inlet directly with the ambient air. The pump will then have to draw in air and thereafter force it through the filter. It will then be necessary to have pressure gauges at the pump outlets for such tests. Obviously other gases may be used instead of air. By using the quantitation pumps for the bubble-point tests it is possible to operate with higher pressures than are normally available in service systems, supplying compressed air in localities, where machines of this type are expected to be used.

The embodiment above described is an example only, in which the components may be varied in many ways within the scope of the appended claims. The filling volumes may, in a practical embodiment, vary between 2 ml and 100 ml per stroke, and conduit 29 may be formed to permit filling of bottles or ampoules of any desired size.

A machine of this type can, of course, operate with a single quantitation cylinder and one servo cylinder, and the machine shown can be provided with a single servo cylinder instead of the two of the present design.

In order to make possible a rapid cleaning and sterilizing, the quantitation cylinders are easily detachable, and if some sets of cylinders are provided it is possible, rapidly to switch over from one solution to another. All conduits and fittings, coming into contact with the solutions, are preferably manufactured of stainless material, and are designed with a view to permit easy handling and cleaning.

What I claim is:

1. A filling machine to handle liquid products comprising at least one quantitation pump, at least one piston servo motor directly connected to the pump for driving the same, and means adapted to determine the stroke of said piston servo motor, a first non-return valve fitted at said at least one pump permitting a liquid product to be drawn into the pump through a supply conduit from a common source of supply, and a second non-return valve permitting said drawn-in product to be expelled from said at least one pump through an outlet conduit to an individual container, a filter mounted in said outlet conduit, and valve means in said supply conduit and connected to a gas supply means, adapted, at will, to interrupt the connection between said source of supply and said pump, and to permit a pressurized gas to be supplied to said filter from said gas supply means for testing purposes.

2. The filling machine according to claim 1, in which said gas supply means is adapted to supply a pressurized gas from an external source directly to said first non-return valve.

3. A filling machine to handle liquid products comprising at least one quantitation pump, at least one piston servo motor directly connected to the pump for driving the same, and means adapted to determine the stroke of said piston servo motor, a first non-return valve fitted at said at least one pump permitting a liquid product to be drawn into the pump through a supply conduit from a source of supply, and a second non-return valve permitting said drawn-in product to be expelled from said pump through an outlet conduit, a filter mounted in said outlet conduit, and valve means in said supply conduit and connected to a gas supply means, adapted, at will, to interrupt the connection between said source of supply and said pump, and to permit a pressurized gas to be supplied to said filter from said gas supply means for testing purposes, said gas supply means being adapted to permit the quantitation pump to draw in ambient air through said first non-return valve, and forcing said air through said second non-return valve and said filter.

4. The filling machine according to claim 1, 2 or 3, in which the servo motor is a compressed air motor, having throttling means for governing the amount of air passing through the motor.

5. The filling machine according to claim 4, in which the means determining the stroke of the servo motor comprises a toothed rack fitted in parallel to its longitudinal axis, a cross bar for cooperation with said rack, and an final position adjustment screw, carried by the cross bar.

6. The filling machine according to claim 1, 2, or 3, comprising two parallel quantitation pumps, complete with first and second non-return valves and valve means, and at least one driving servo motor mounted between said pumps.

* * * * *